United States Patent [19]

Horii et al.

[11] 4,404,902

[45] Sep. 20, 1983

[54] ROTARY DUPLICATING MACHINE WITH AUTOMATIC STENCIL PAPER DISCHARGE

[75] Inventors: Juichi Horii; Shuichi Nakajima, both of Tokyo; Eiji Takahashi, Yokohama, all of Japan

[73] Assignee: Horii Toshado Kabushiki Kaisha, Tokyo, Japan

[21] Appl. No.: 396,480

[22] Filed: Jul. 8, 1982

[30] Foreign Application Priority Data

Sep. 2, 1981 [JP] Japan ..... 56/136978

[51] Int. Cl.[3] ..... B41L 13/08; B41F 15/08

[52] U.S. Cl. ..... 101/122; 101/127.1

[58] Field of Search ..... 101/121, 122, 126, 127.1, 101/132.5; 271/DIG. 2

[56] References Cited

U.S. PATENT DOCUMENTS

| | | | |
|---|---|---|---|
| 1,798,371 | 3/1931 | Creed | 101/122 |
| 2,730,042 | 1/1956 | Styles et al. | 101/122 |
| 4,134,338 | 1/1979 | Selman | 101/122 |

FOREIGN PATENT DOCUMENTS

| | | | |
|---|---|---|---|
| 476778 | 12/1952 | Italy | 101/127 |

*Primary Examiner*—E. H. Eickholt

*Attorney, Agent, or Firm*—Wenderoth, Lind & Ponack

[57] ABSTRACT

The disclosed rotary duplicating mimeograph machine comprises an endless belt type rotating screen, a clamping and a stencil raising element disposed on the screen adjacent to each other, and a rectangular bit of cut stencil paper with a head somewhat thicker than its main body disposed on the screen by having the head clamped by the clamping element and engaged by the raising element. After the printing, a cam actuates the two elements to release the head and then raise the head. Two takeup pawls disposed in spaced relationship with the screen outside its opposite edges are operated to engage the head and wrap the stencil bit about the head. A stencil discharging element located between the pawls is turned to discharge the wrapped bit disengaged from the pawls to a receptacle disposed below it.

5 Claims, 4 Drawing Figures

ROTARY DUPLICATING MACHINE WITH AUTOMATIC STENCIL PAPER DISCHARGE

BACKGROUND OF THE INVENTION

This invention relates to improvements in a rotary duplicating machine and more particularly to an automatic stencil discharge device disposed on such a machine to automatically discharge a bit or bits of stencil paper having been used or being used.

The most troublesome work included in the mimeograph is to remove a used bit of stencil paper from the particular duplicating machine after the completion of the printing and dispose of the removed bit of cut stencil paper having a large amount of an ink attached thereto. This work has inevitably soiled the hand and clothes of the user.

According it is an object of the present invention to provide a new and improved rotary duplicating machine of the single or double cylinder type from which a used bit of stencil paper can be automatically discharged without the hand and clothes of the user soiled with an ink attached in a large amount to the used stencil paper.

SUMMARY OF THE INVENTION

The present invention provides a rotary duplicating machine comprising a rotary screen formed into an endless belt, a bit of cut stencil paper including a head somewhat thicker than the main body thereof and clamped to the rotary screen, and an automatic stencil discharge device operative after the completion of the printing operation to release the clamped head of the bit of stencil paper, and raise the released head from the rotary screen, the automatic stencil discharge device including a pair of opposite stencil takeup pawls disposed outside of both edges of the rotary screen to be spaced from the rotary screen in a direction perpendicular to a portion thereof near to the pawls and having an operating position where the pawls carry the raised head of the bit of cut stencil paper therebetween and then are rotated to wrap the bit of stencil paper about the head thereof carried between the takeup pawls, the pair of stencil takeup pawls being retracted to an inoperative position after the wrapping of the bit of cut stencil paper to discharge the wrapped bit of stencil paper therefrom.

In a preferred embodiment of the present invention, the automatic stencil discharge device may include a clamping element disposed on the rotary screen to clamp the head of the bit of stencil paper, a stencil raising element disposed on the rotary screen to be substantially parallel and adjacent to the clamping element upstream thereof in a direction of rotation of the screen to be overlaid with the head of the bit of stencil paper to put the bit of stencil paper in place on the screen, cam disposed adjacent to one end of the clamping and raising elements to actuate those elements one after the other so that the clamping element releases the head of the bit of stencil paper and then the stencil raising element raises the head of the bit of stencil paper from the screen, and a stencil positioning element disposed to be spaced from the screen downstream of the clamping element in the direction of rotation of the screen to be put between the pair of stencil takeup pawls, the stencil positioning element being turned in a direction opposite to the direction of rotation of the screen to discharge the wrapped bit of stencil paper removed from the stencil takeup pawls to a receptacle located thereunder.

In order to put the bit of stencil paper in place on the screen, the bit of stencil paper may be rectangular and include a plurality of holes disposed at predetermined equal intervals on the head adjacent to a portion of the head connected to the main body bit of cut stencil paper and widthwise thereof while the stencil raising element includes a plurality of bosses disposed at predetermined equal intervals so as to be fitted into the holes on the head of the bit of cut stencil paper.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
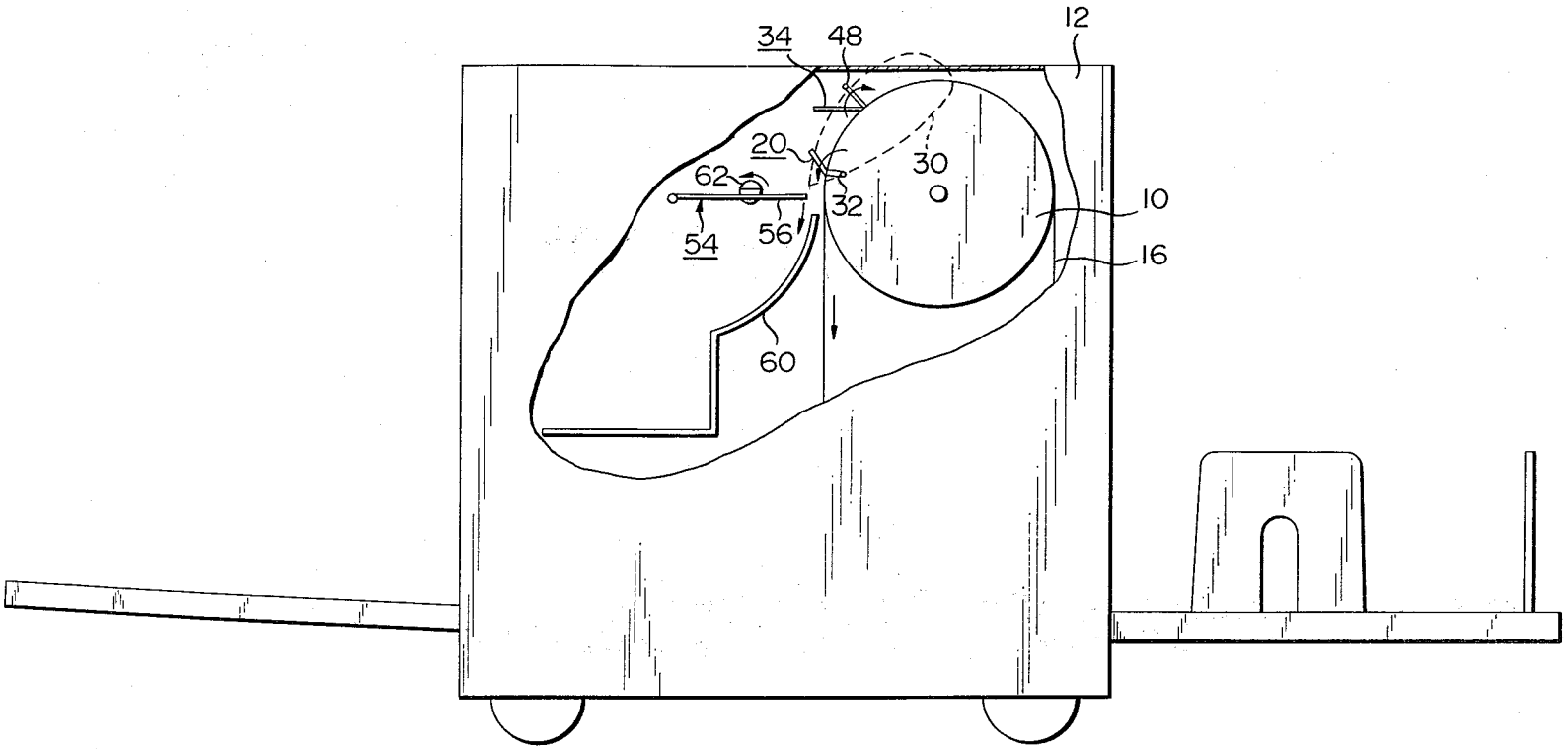
FIG. 1 is a side elevational view of one embodiment according to the rotary duplicating machine of the present invention with a part cut away to illustrate the internal construction thereof.
Figure 2:
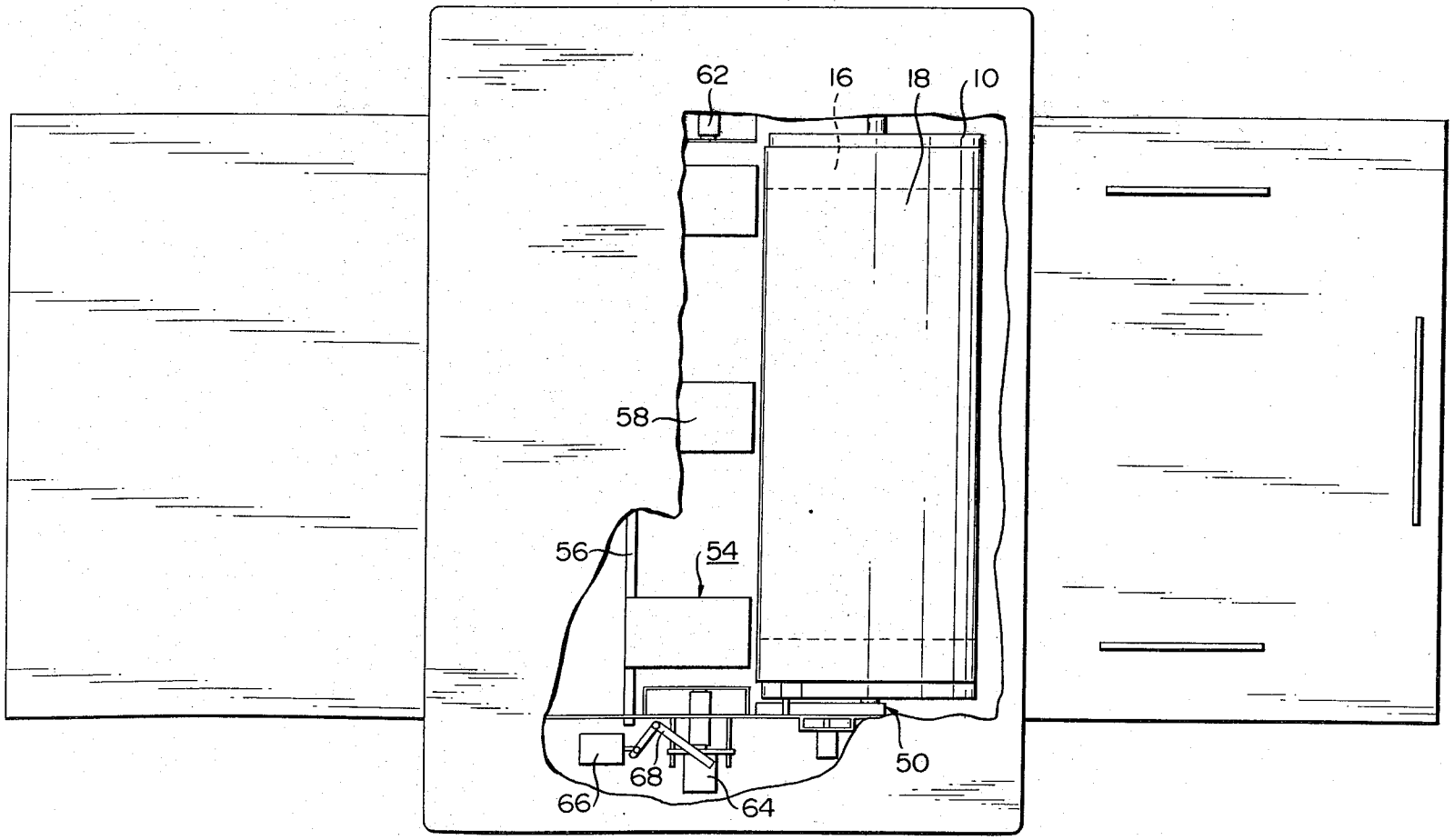
FIG. 2 is a plan view of the arrangement showh in FIG. 1 with a part cut away to illustrate the internal constructure thereof.

Referring now to FIGS. 1 and 2 of the drawings, there is illustrated one embodiment according to a rotary duplicating machine including the automatic stencil discharge device of the present invention. The arrangement illustrated is of the double cylinder type and comprises a pair of upper and lower cylinders 10 rotatably supported to a frame 12 for the main body thereof although FIG. 1 shows only the upper cylinder 10 only for purposes of illustration. Then an endless belt 16 is spanned between the upper and lower cylinders 10 and formed of a screen 18 except for both edge portions thereof (see FIG. 2).

In order to position a bit of cut stencil paper and particularly a head thereof in place on the screen 18, a clamping element generally designated by the reference numeral 20 is disposed on the endless belt 16 to extend widthwise of the endless belt 16.

Figure 3:
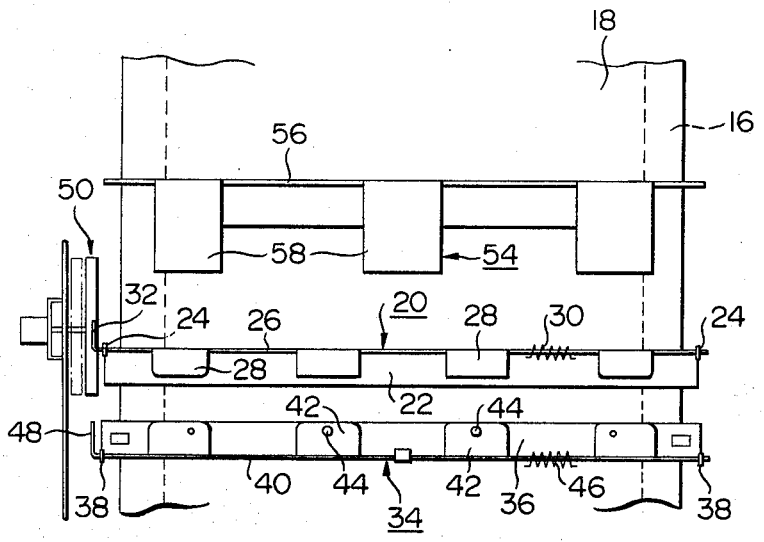
FIG. 3 is a somewhat exploded side elevational view in an enlarged scale of the clamping, stencil raising and positioning elements shown in FIG. 1.

As shown best in FIG. 3, the clamping element 20 includes a strip-shaped support plate 22 fixed on both end portions to the endless belt 16 to extend widthwise thereof, a pair of brackets 24 disposed at both ends of the support plate 22, a clamping rod 26 rotatably journalled by the brackets 24, and a plurality of rectangular clamping plates 28, in this case, four plates fixed on one side at predetermined equal intervals to the clamping rod 26.

Further a spring 30 is disposed around the clamping rod 26 between a selected pair of adjacent clamping plates 28, in this case, the rightmost plate 28 as viewed in FIG. 3 and the adjacent plate 28 to tend to normally force the clamping plates 28 toward the supporting plate 22. Also the clamping rod 26 includes one end portion adjacent to the frame 12 and bent into an L forming an arm 32 acting as a cam follower.

A stencil raising element generally designated by the reference numeral 34 is disposed on the endless belt 16 adjacent to the clamping element 20 and upstream thereof in a direction of travel of the endless belt 16 shown in FIG. 1 as being downward. The stencil raising element 34 extends similarly widthwise of the endless belt 16 and includes a raising support plate 36 in the form of a strip fixed on both end portion to the endless belt 16 to be substantially parallel to the clamping support plate 26, a pair of brackets 38 disposed at both ends of the support plate 36, a raising rod 40 journalled by the brackets 38, and a plurality of raising rectangular plates 42 substantially equal in dimension to the clamping rectangular plates 42, in this case, four plate fixed on one side to the raising rod 40 to be substantially aligned with the clamping plates 28 in the longitudinal axis of the endless belt 16. Unlike the clamping plates 42, the raising plates 42 have respectively boses 44 disposed remotely from those sides connected to the raising rod 40. As in the clamping element 20, a spring 46 is disposed around the raising rod 40 between the rightmost plate 42 as viewed in FIG. 3 and the adjacent plate 42 and tends to normally force the raising plats 42 toward the raising support plate 36. That end portion of the raising rod 40 near to the frame 12 is bent into an L forming an arm 48 acting as a cam follower.

It is noted that the clamping and raising elements 20 and 34 respectively are arranged to be turnable in a counterclockwise and a clockwise direction as viewed in FIG. 1 about the longitudinal axes of the respective rods 26 and 40 for the purpose as will be apparent hereinafter. This the clamping element 20 is opposite in turning direction to the stencil raising element 34.

The arrangement comprises further an oval cam 50 disposed above and to the left of the upper cylinder 10 as shown at dotted line in FIG. 1. As shown best in FIG. 3, the cam 50 is supported by the frame 12 through a cam pin 52 so that it is substantially parallel to the bent ends or arms 32 and 48 of the clamping and raising elements 20 and 34 respectively and axially movable from one to the other of its two positions as by an electromagnet (not shown) but not rotatable about its own axis. More specifically the cam 50 has one position as shown at dotted-and-dashed line in FIG. 3 at which the cam 50 is nearer to the frame 12 and prevented from engaging either one of the arms 32 and 48 or cam followers of the clamping and raising elements 20 and 34 respectively and the other position displaced toward the endless belt 16 as shown at solid line FIG. 3. At the other position thereof the cam 50 can be engaged on the lower periphery as viewed in FIG. 1 by the arm or cam follower 32 of the clamping element 22 and on the upper periphery by the arm or cam follower 48 of the stencil raising element 34.

The cam 50 engages the clamping arm 32 to turn the clamping element 20 in the counterclockwise direction as viewed in FIG. 1 or the direction of travel of the endless belt 16 to release a bit of stencil paper from the clamping element 20. However when the cam 50 engages the raising arm 48, the stencil raising element 34 is turned in the clockwise direction as viewed in FIG. 1 or a direction opposite to the direction of travel of that portion of the endless belt 16 facing the same to raise the bit of cut stencil paper disposed thereupon from the screen 18.

Thus the single cam 50 can perform simultaneously both the operation of releasing the bit of stencil paper from the clamping element 20 and that of raising it from the latter.

As shown in FIG. 1, a positioning element generally designated by the reference numeral 54 is disposed substantially perpendicularly to the surface of the endless belt 16 to extend short of the surface of the endless belt 16. As shown in FIGS. 2 and 3, the positioning element 54 includes a positioning rod 56 rotatably supported by the frame 12 and the opposite frame (not shown) to be horizontal and substantially parallel to the clamping and raising rods 20 and 34 respectively, and a plurality of positioning rectangular plates 58, in this case, three rectangular plates having one side fixed at predetermined equal intervals to the positioning rod 56. The positioning plates 56 is larger in dimention than the clamping and raising plates 28 and 42 respectively and arranged to be turnable in a clockwise direction as viewed in FIG. 1 about the longitudinal axis of the positioning rod 54. When orthogonally projected on the screen 18, each of the plates 58 is located at a predetermined distance from the clamping element 20 downstream thereof in the direction of travel of that portion of the screen 18 facing the plates 58 for the purpose as will be apparent later. In FIG. 1 a receptacle 60 is also shown as being located below the positioning element 54 and including an upper portion having a curved section convex toward the endless belt 16 and terminating at a lower L-shaped L portion having with one leg of the L being horizontal to form the bottom of the receptacle 60. In order to accommodate a bit or bits of stencil paper after having been used, a cassette (not shown) is disposed on the bottom of the receptacle 60.

Further a pair of rotary takeup pawls 62 are disposed outside of both edges of the screen 18 to be spaced therefrom in a direction perpendicular to that portion thereof near to the pawls so as to be opposite to each other and put the positioning element 54 therebetween with a spacing formed between each of the pawls 62 and the adjacent end the positioning plate 58. Each of the pawls 62 may have any suitable shape such as a fork- or a trident shape and is arranged to be rotated in the same direction as the cylinder 10 to rotate a head of stencil paper engaged thereby as will be described later at a speed substantially equal to that of the cylinder 10. To this end, the takeup pawls 62 are operatively connected to an electric motor 64 disposed on that side of the frame 12 remote from the positioning element 54 as shown in FIG. 2. Alternatively the take-up pawls 62 may be operatively connected to driving means (not shown) for driving the main body such as the cylinders 10.

Each of the takeup pawls 62 is normally put in its retracted position where it is disabled and its operating position displaced toward the positioning element 52. In order to displace the pawls 62 from their retracted to their operating positions, an electromagnet 66 is disposed on the same side of the frame 12 as the electric motor 64 and an L-shaped lever 68 is connected to the electromagnet 66 to push the pawls 62 in their operating positions in response to the energization of the electromagnet 66.

Figure 4:
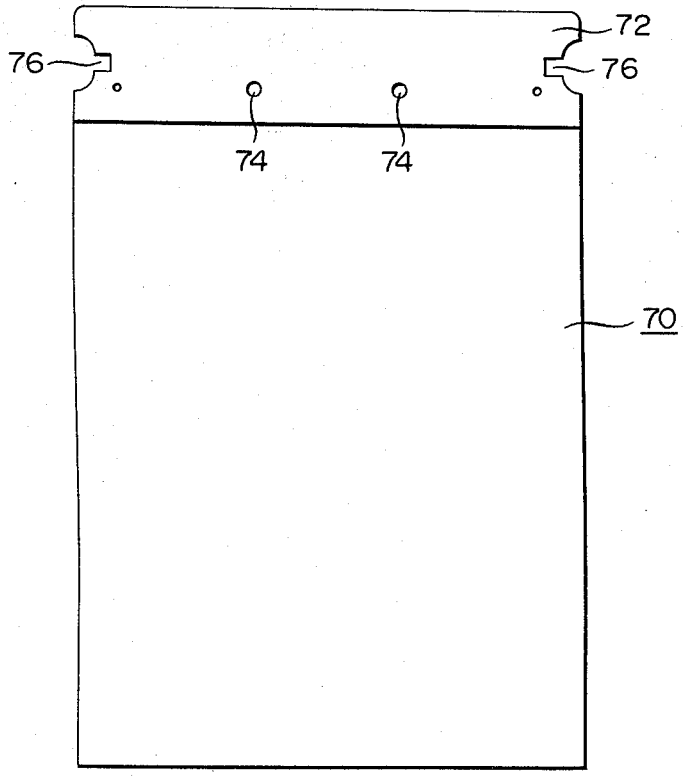
FIG. 4 is a plan view of a bit of cut stencil paper with a head used with the present invention.

FIG. 4 shows a rectangular bit of stencil paper suitable for use with the present invention. As shown, the rectangular bit of stencil paper is generally designated by the reference numeral 70 and includes a head 72 somewhat thicker than the same and connected to one edge, in this case, the upper edge thereof as viewed in FIG. 4. The head 72 includes a plurality of positioning holes 74 in this case, four holes disposed thereon at predetermined equal intervals adjacent to the rectangular bit 70 so as to engage the bosses 44 disposed on the stencil raising element 34 for the purpose as will be apparent later. The head 72 includes further a pair of notches 76 disposed on the opposite sides thereof 72 to be capable of engaging the pair of takeup pawls 60 brought into their operating positions respectively.

In operation the head 72 of the stencil bit 70 cut as required is first clamped to the clamping element 20 by having its leading edge resiliently put between the support plate 22 and the clamping plates 28 of the clamping element 20 and then the positioning holes 74 on the head 72 are engaged by the bosses 44 on the raising plates 42 of the stencil raising element 34 overlaid with the head 72 respectively until the same is disposed in spanned state on the screen 18. This results in readiness for the printing operating.

Then the printing operation is performed by suitably supplying an ink to the main body of the stencil until a predetermined number of copies is printed. At that time the printing operation is completed to stop the rotation of the cylinder 10. Thereafter a stencil discharge switch (not shown) is operated to electrically move the cam 50 to its operating position nearer to the clamping and stencil raising elements 20 and 34 respectively, and also the cylinders 10 are initiated to be slowly rotated at a low speed. During this low speed rotation of the cylinders 10 the lower periphery of the cam 50 first pushes the end of the arm or cam follower 24 of the clamping element 20 to rotate that element in a the direction of travel of the adjacent portion of the screen 18 about the longitudinal axis of the clamping rod 26. This results in the release of the stencil head 72 from the clamping element 20.

Following this the upper periphery of the cam 50 is engaged by the arm or cam follower 46 of the stencil raising element 34 to cause the latter to be rotated in a direction opposite to that of travel of the adjacent portion of the screen 18 about the longitudinal axis of the raising rod 40. Thus the stencil head 72 is raised from the screen 18 until it is kept apart from the screen 18. Since the cylinders 10 continue to be further rotated at the low speed, the stencil bit 70 is delivered to the positioning element 56 while the head 72 is maintained in its raised position. In this way the head 72 reaches its predetermined position whereupon the cylinders 10 are stopped to be rotated and simultaneously the electromagnet 66 is energized to move the takeup pawls 62 to their operating positions near to the positioning element 56 through the lever 68. This results in the insertion of the forked ends of the pawls 62 into the notches 76 on the stencil head 72 respectively.

Then the positioning element 56 is rotated in a downward direction as viewed in FIG. 1 or the direction of travel of that portion of the screen 18 facing the same about the longitudinal axis of the positioning rod 56 until the same reaches it position where it does not interfere with the takeup of the bit of stencil paper 70. At that time the positioning element 56 is stopped.

Following this, the cylinders 10 are initiated again to be rotated in the counterclockwise direction shown in FIG. 1 while at the same time the takeup pawls 62 are initiated to be slowly rotated in the same direction as the cylinders 10 with the results that the bit of cut stencil paper 70 wraps up itself about a line connecting those opposite portions of the head 72 carried by the stencil takeup pawls 62. At that time the takeup pawls 62 are preferably rotated to rotate the bit of stencil paper 70 about that line at a rotational speed substantially equal to that of the cylinder 20.

In this way the rectangular bit of stencil paper 70 has been wrapped up by the takeup pawls 60 and automatically discharged from the surface of the screen 10. When the stencil bit 70 has been fully removed from the screen 18 to complete the discharge thereof, the electromagnet 66 is deenergized to permit the takeup pawls 62 to be retracted to and held at its retracted position. This results in the release of the pawls 62 from the wrapped stencil bit 70.

Therefore the bit of cut stencil paper 70 wrapped about its head 72 slides along the curved surface of the receptacle 66 located below the positioning element 56 by means of its own weight until it is housed in the cassette (not shown) disposed on the receptacle 66. At that time, the wrapped bit of stencil paper may stick to the curved surface of the receptacle 60 by means of a force of the particular ink applied to the bit of stencil paper. However, such a wrapped bit is delivered to the interior of the cassette by means of the positioning element 56 rotated toward the wrapped bit sticked to the receptable 60 upon the next succeeding discharge of a wrapped bit of stencil paper. At that time, the delivered bit is prevented from soiling the hand and cloths of the operator.

As described above, the positioning element 58 has been rotated to its lower position where it does not interfere with the discharge of the stencil bit. The positioning element 58 brought into its lower position can be returned back to its original position through the depression of a stencil discharge pushbutton (not shown).

From the foregoing it is seen that, according to the present invention, a bit of stencil paper having been used can be automatically discharged without the hand of the operator soiled. Also with the casette formed of a discardable cardboard, some bits of cut stencil paper used can be successively heaped in such a cassette after which they can be conveniently discarded with the cassette.

While the present invention has been illustrated and described in conjunction with a single preferred embodiment thereof it is to be understood that numerous changes and modifications may be resorted to without departing from the spirit and scope of the present invention. For example, a single strip-shaped plate may be substituted for the plurality of discrete clamping plates 28. This is true in the case of the positioning plates 58. With a single strip-shaped raising plate substituted for the plurality of raising plates, it will readily be understood that the single strip-shaped plate should be provided with bosses 44. Also the takeup pawls 62 may be moved by a suitable lever actuating mechanism such as springs or grooved cams but not by the electromagnet 66.

What is claimed is:

1. A rotary duplicating machine comprising a rotary screen formed into an endless belt, a bit of cut stencil paper including a head somewhat thicker than a main body thereof and clamped to the rotary screen, and an automatic stencil discharging device operative after the completion of the printing operation to release the clamped head of the bit of cut stencil paper, and raise the released head from the rotary screen, the automatic stencil discharge device including a pair of opposite stencil takeup pawls disposed outside of both edges of the rotary screen to be spaced from the rotary screen in a direction perpendicular to a portion thereof near to the pawls and having an operating positions where the pawls carry the raised head of the bit of cut stencil paper therebetween, then are rotated to wrap the bit of stencil paper about the head thereof carried between the takeup pawls, the pair of stencil pawls being retracted to an inoperative position after the wrapping of the bit of stencil paper to discharge the wrapped bit of stencil paper therefrom.

2. A rotary duplicating machine as claimed in claim 1 wherein the automatic stencil discharge device includes a clamping element disposed on the rotary screen to clamp the head of the bit of stencil paper, a stencil raising element disposed on the rotary screen to be substantially parallel and adjacent to the clamping element and upstream thereof in a direction of rotation of the screen to be overlaid with the head of the bit of stencil paper to put the bit of stencil paper in place on the screen, cam disposed adjacent to one end of the clamping and raising elements to actuate the clamping and raising elements one after the other so that the clamping element release the head of the bit of cut stencil paper and then the stencil raising element raises the head of the bit of cut stencil paper from the screen, and a stencil positioning element disposed to be spaced from the screen downstream of the clamping element in the direction of rotation of the screen to be put between the pair of stencil takeup pawls, the stencil positioning element being turned in a direction opposite to the direction of rotation of the screen to discharge the wrapped bit of cut stencil paper removed from the stencil takeup pawls to discharge to a receptable located thereunder.

3. A rotary duplicating machine as claimed in claim 1 wherein there is provided an electromagnet responsive to the energization thereof to move the pair of takeup pawls from its inoperative to its operative position through a lever interposed therebetween.

4. A rotary duplicating machine as claimed in claim 1 or 2 wherein the bit of stencil paper is rectangular and includes a plurality of holes disposed at predetermined equal intervals on the head adjacent to a portion thereof head connected to the main body of the bit of stencil paper and widthwise thereof and the stencil raising element includes a plurality of bosses disposed at predetermined equal intervals so as to be fitted into the holes on the head of the bit of cut stencil paper.

5. A rotary duplicating machine as claimed in claim 4 wherein the head of the bit of stencil paper includes a pair of opposite notches on the opposite sides thereof to be engaged by the pair of takeup pawls respectively.

* * * * *